US009360801B2

(12) United States Patent
Takahashi

(10) Patent No.: US 9,360,801 B2
(45) Date of Patent: Jun. 7, 2016

(54) IMAGE FORMING APPARATUS WITH REMOVABLY ATTACHED TONER LEAKAGE PREVENTING MEMBER

(71) Applicant: KYOCERA Document Solutions Inc., Osaka-shi (JP)

(72) Inventor: Satoru Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/724,387

(22) Filed: May 28, 2015

(65) Prior Publication Data

US 2015/0346640 A1 Dec. 3, 2015

(30) Foreign Application Priority Data

May 29, 2014 (JP) ..... 2014-110808

(51) Int. Cl.
*G03G 21/18* (2006.01)
*G03G 15/08* (2006.01)

(52) U.S. Cl.
CPC ..... *G03G 15/0898* (2013.01); *G03G 21/1828* (2013.01); *G03G 2215/00544* (2013.01); *G03G 2215/0875* (2013.01); *G03G 2221/169* (2013.01)

(58) Field of Classification Search
CPC ..... G03G 15/0841; G03G 15/0843; G03G 21/1828; G03G 21/1832
See application file for complete search history.

(56) References Cited

U.S. PATENT DOCUMENTS

| | | | | |
|---|---|---|---|---|
| 6,763,200 | B2 * | 7/2004 | Sakai | G03G 15/0266 399/27 |
| 6,944,414 | B2 | 9/2005 | Harumoto et al. | |
| 9,058,016 | B2 * | 6/2015 | Hamaya | G03G 21/1832 |
| 2004/0165908 | A1 | 8/2004 | Harumoto et al. | |
| 2013/0209113 | A1 * | 8/2013 | Akimoto | G03G 15/70 399/21 |

FOREIGN PATENT DOCUMENTS

| | | | |
|---|---|---|---|
| JP | 07311536 | A * | 11/1995 |
| JP | 2000056535 | A * | 2/2000 |
| JP | 2004-191677 | A | 7/2004 |

* cited by examiner

*Primary Examiner* — Clayton E Laballe
*Assistant Examiner* — Leon W Rhodes, Jr.
(74) *Attorney, Agent, or Firm* — Studebaker & Brackett PC

(57) ABSTRACT

An image forming apparatus includes a main housing, a drum unit, a developing unit, a toner container, and a paper conveyance unit. The drum unit includes a photosensitive drum. The developing unit includes a developer roller that develops a toner image on the photosensitive drum. The toner container contains toner. The paper conveyance unit is openable and closable. The image forming apparatus includes a toner leakage preventing member that is removably attached to the housing so as to extend through a space formed between the paper conveyance unit and each of the drum unit and the developing unit.

8 Claims, 3 Drawing Sheets

IMAGE FORMING APPARATUS WITH REMOVABLY ATTACHED TONER LEAKAGE PREVENTING MEMBER

INCORPORATION BY REFERENCE

The present application claims priority under 35 U.S.C. §119 to Japanese Patent Application No. 2014-110808, filed May 29, 2014. The contents of this application are incorporated herein by reference in their entirety.

BACKGROUND

The present disclosure relates to image forming apparatuses used for example as copiers, printers, and facsimile machines.

When an image forming apparatus is shipped without removing a developer unit containing developer, the developer may leak from the developer unit during transportation. To prevent toner leakage during transportation, a developer leakage preventing member is attached within the internal space of the drum unit of the image forming apparatus to provide sealing against leakage of the toner.

SUMMARY

An image forming apparatus according to the present disclosure includes a main housing, a drum unit, a developing unit, a toner container, and a paper conveyance unit. The drum unit includes a photosensitive drum. The developing unit includes a developer roller that develops a toner image on the photosensitive drum. The toner container contains toner. The paper conveyance unit is openable and closable. The image forming apparatus includes a toner leakage preventing member that is removably attached to the main housing so as to extend through a space formed between the paper conveyance unit and each of the drum unit and the developing unit.

DETAILED DESCRIPTION

Figure 1:
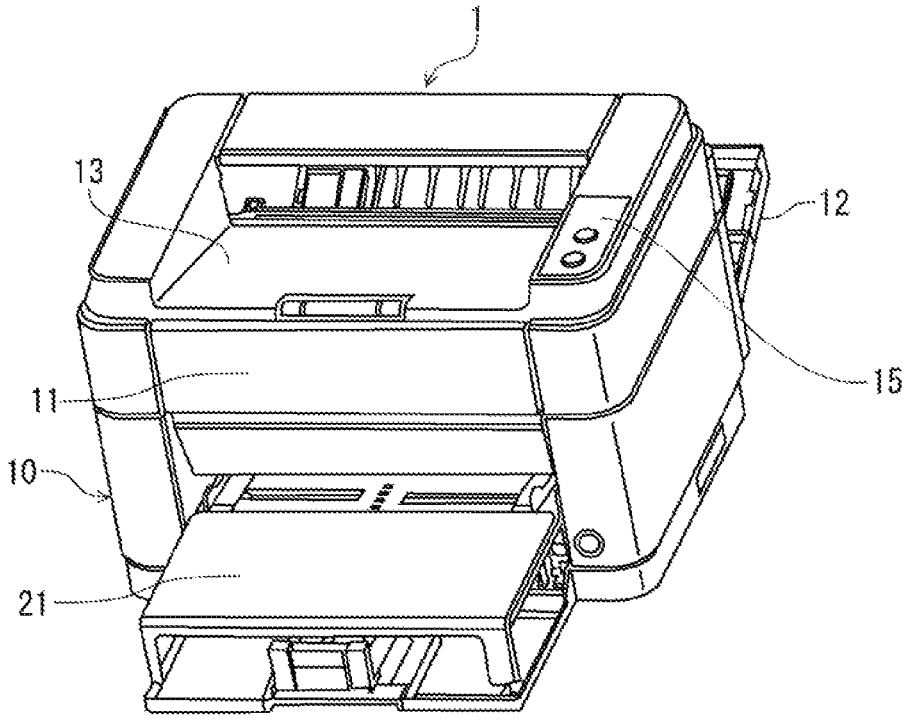
FIG. 1 is a perspective view showing the external appearance of an image forming apparatus according to an embodiment of the present disclosure.
Figure 2:
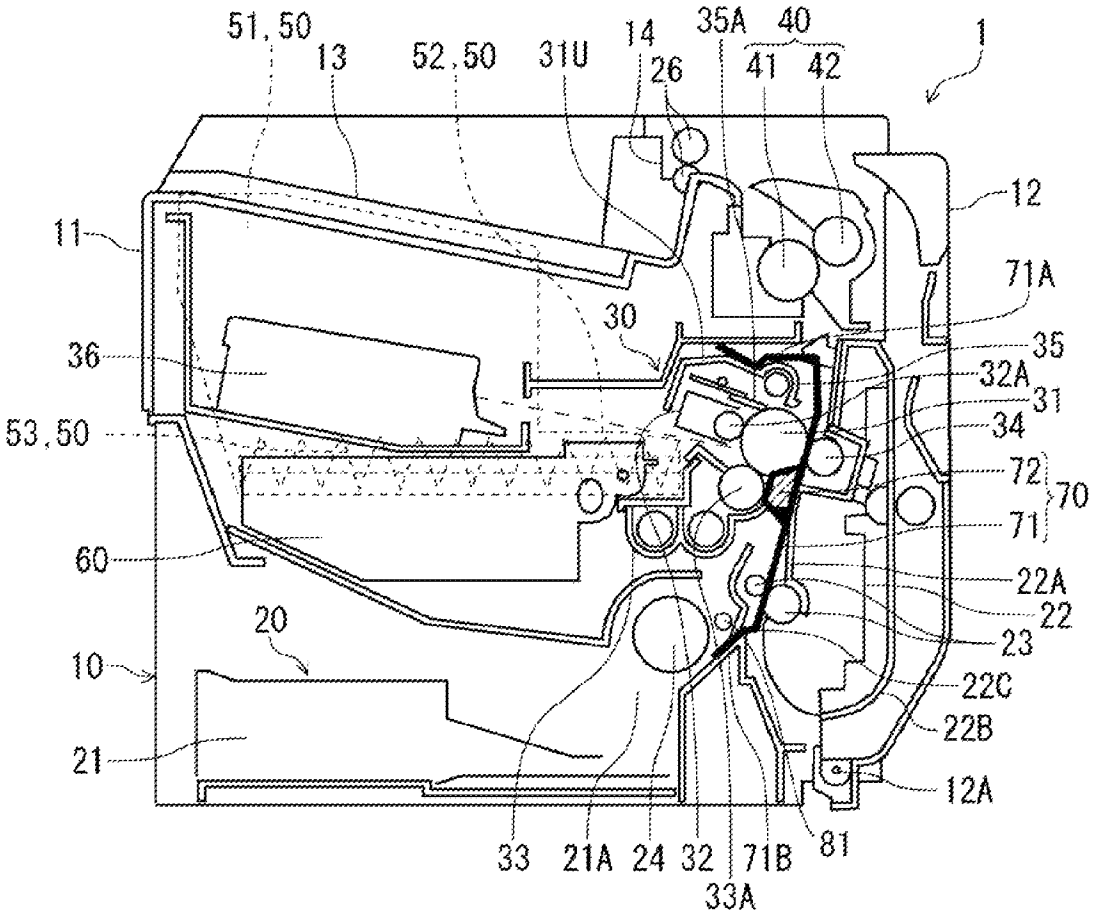
FIG. 2 is a side cross-sectional view showing the internal structure of the image forming apparatus according to an embodiment of the present disclosure.
Figure 3:
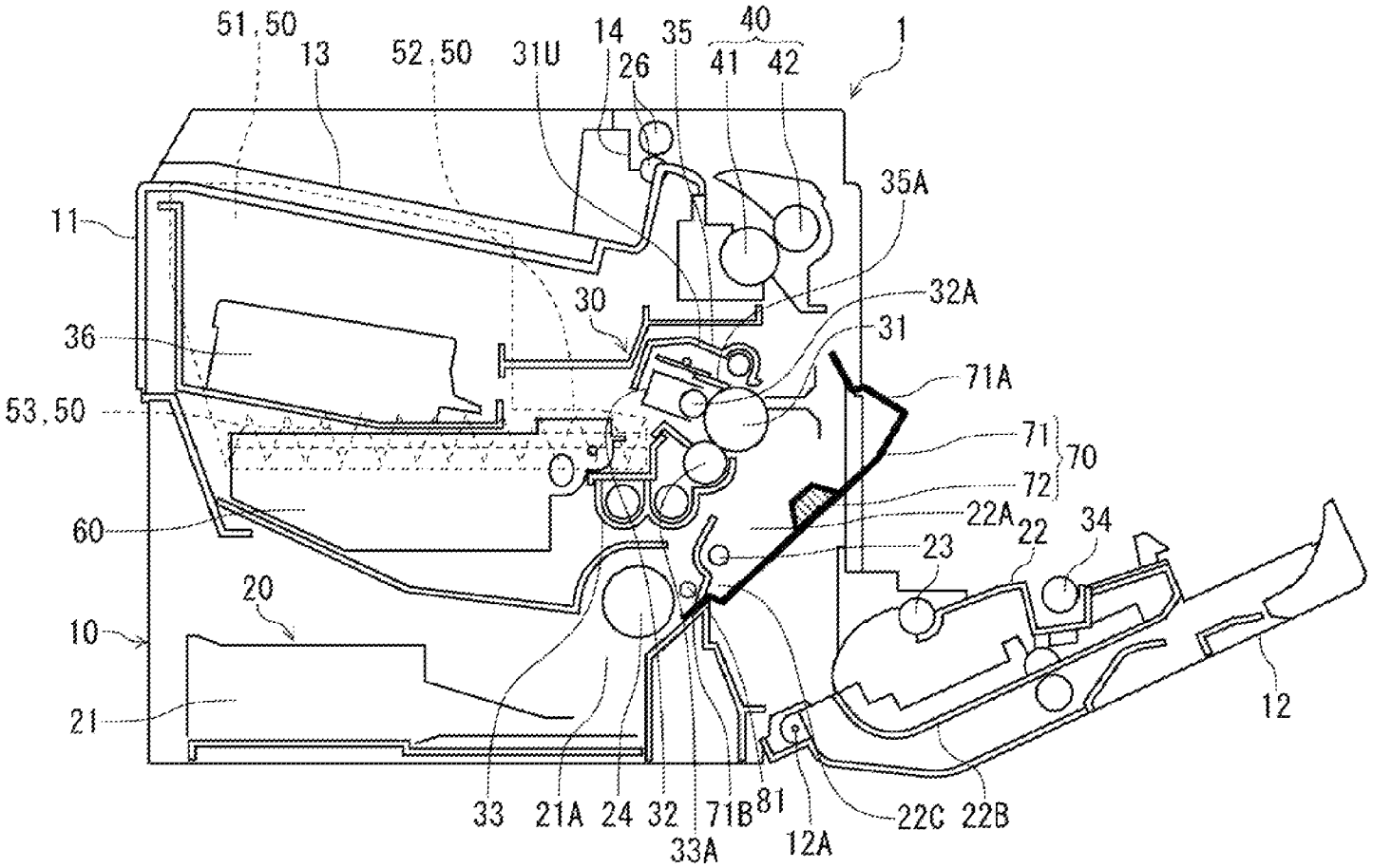
FIG. 3 is a side cross-sectional view showing the internal structure of the image forming apparatus shown in FIG. 2, with a rear cover left open.

The following describes an embodiment of the present disclosure in detail with reference to the accompanying drawings. FIG. 1 is a perspective view of the external appearance of an image forming apparatus 1 according to the embodiment of the present disclosure. FIG. 2 is a side cross-sectional view showing the internal structure of the image forming apparatus 1. FIG. 3 is a side cross-sectional view showing the internal structure of the image forming apparatus 1 with a rear cover 12 (described later) left open. Although the image forming apparatus 1 according to the present embodiment is a monochrome printer, this is only an example. The image forming apparatus may be a copier, a facsimile machine, or a multifunction peripheral combining functions of such machines. Also, the image forming apparatus may be a color image forming apparatus.

The image forming apparatus 1 includes a main housing 10 roughly having the shape of a rectangular parallelepiped and also includes a paper feed section 20, an image forming section 30, a fixing section 40, a toner container 50, a toner collection tank 60, and a toner leakage preventing member 70 that are housed in the main housing 10.

The main housing 10 includes a front cover 11 at a front side thereof and a rear cover 12 at a rear side thereof. The front cover 11 is opened by a user for removing the toner container 50 from the main housing 10 when the toner container 50 is out of (has run out of) toner. The rear cover 12 is opened for attaching or removing the toner leakage preventing member 70, for clearing sheet jam or for maintenance. Each of the image forming section 30, the fixing section 40, and the toner leakage preventing member 70 can be removed from the main housing 10 while the rear cover 12 is open.

The paper feed section 20 includes a paper conveyance unit 22 and a paper feed cassette 21 for storing sheets of paper that are to be subjected to image formation. A sheet pickup section 21A is disposed above the rear end of the paper feed cassette 21. The sheet pickup section 21A includes a paper feed roller 24 that feeds sheets stacked in the paper feed cassette 21 one by one from the topmost sheet.

The image forming section 30 transfers a toner image to a sheet fed from the paper feed section 20. The image forming section 30 includes a photosensitive drum 31, a charging device 32, an exposure device 36, a developing unit 33, a transfer roller 34, and a cleaning device 35. The charging device 32, the exposure device 36, the developing unit 33, the transfer roller 34, and the cleaning device 35 are arranged around the photosensitive drum 31.

The photosensitive drum 31 rotates axially while an electrostatic latent image is formed on a circumferential surface of the photosensitive drum 31 and developed into a toner image. The photosensitive drum 31 may for example be a photosensitive drum formed from an organic photosensitive material or an amorphous silicon (a-Si)-based photosensitive material. The charging device 32 uniformly charges the surface of the photosensitive drum 31. The charging device 32 includes a charging roller 32A that abuts against the photosensitive drum 31. The developing unit 33 includes a development roller (developer bearing member) 33A located opposite to the photosensitive drum 31 and is filled with a predetermined amount of developer. The cleaning device 35 includes a cleaning blade 35A for cleaning toner off from the circumferential surface of the photosensitive drum 31 after toner image transfer and conveys the cleaned-off toner to the toner collection tank 60, which will be described later. The photosensitive drum 31, the charging device 32, and the cleaning device 35 are integrated as a drum unit 31U.

The exposure device 36 includes a laser light source and optical components such as mirrors and lenses. The exposure device 36 forms an electrostatic latent image by irradiating the circumferential surface of the photosensitive drum 31 with light modulated according to image data acquired from an external device such as a personal computer. The developing unit 33 supplies toner to the circumferential surface of the photosensitive drum 31, thereby developing the electrostatic latent image thereon. The transfer roller 34 is for transferring the toner image formed on the circumferential surface of the photosensitive drum 31 to a sheet and forms a transfer nip with the photosensitive drum 31. A transfer bias of opposite polarity to the toner is applied to the transfer roller 34.

The fixing section 40 performs a fixing process of fixing the transferred toner image on the sheet. The fixing section 40 includes a pressure roller 42 and a fixing roller 41 having a heat source inside. The pressure roller 42 is pressed against the fixing roller 41 to form a fixing nip with the fixing roller 41. While a sheet having a toner image transferred thereto is passed though the fixing nip, the fixing roller 41 applies heat and the pressure roller 42 applies pressure to the sheet so that the toner image is fixed.

The toner container 50 contains toner for replenishing the developing unit 33. The toner container 50 includes: a main container body 51 where the majority of toner is stored; a tubular portion 52 projecting from a lower side surface of the main container body 51; and a rotational member 53 for conveying toner in the toner container 50. The rotational member 53 is rotationally driven to supply the toner contained in the toner container 50 to the developing unit 33 through a toner outlet formed in the lower surface of the tubular portion 52 at a tip thereof.

The toner container 50 is removably attached to the main housing 10 of the image forming apparatus 1. When the toner contained in the toner container 50 is consumed for image formation by the image forming apparatus 1 and decreases to a low level (or runs out), the toner container 50 can be replaced with another toner container.

The paper conveyance unit 22 is located opposite to the inner surface of the rear cover 12. The paper conveyance unit 22 and the rear cover 12 are each pivotally supported on a common pivot 12A. The rear cover 12 has a lock portion (not shown) that engages with the main housing 10 to keep the rear cover 12 closed. The rear cover 12 also has an unlock portion that disengages the lock portion to allow the rear cover 12 to open outward by pivoting about the pivot 12A. The paper conveyance unit 22 is pressed by the rear cover 12 when the rear cover 12 is closed inward and thus pivots about the pivot 12A so as to be appropriately positioned relative to the drum unit 31U. While the rear cover 12 is open, the paper conveyance unit 22 can be opened away from the drum unit 31U.

Within the main housing 10, a main conveyance path 22A and a reverse conveyance path 22B are formed for conveying sheets. The main conveyance path 22A extends from the sheet pickup section 21A of the paper feed section 20 through the image forming section 30 and the fixing section 40 to the paper exit port 14. The paper exit port 14 opens onto a paper discharge section 13 located on the top face of the main housing 10. The reverse conveyance path 22B is used in duplex printing to convey a sheet after printing of a first side of the sheet to a location upstream of the image forming section 30 in the main conveyance path 22A. The front face of the paper conveyance unit 22 forms one side of the main conveyance path 22A between the paper conveyance unit 22 and each of the drum unit 31U and the developing unit 33. The rear face of the paper conveyance unit 22 forms one side of the reverse conveyance path 22B between the paper conveyance unit 22 and the inner face of the rear cover 12.

A pair of registration rollers 23 is located upstream in the main conveyance path 22A from the transfer nip that is formed between the photosensitive drum 31 and the transfer roller 34. One of the registration rollers 23 is attached to the main housing 10 and the other to the paper conveyance unit 22. The pair of registration rollers 23 temporarily holds a sheet in place, applies skew correction thereon, and then feeds the sheet to the transfer nip with predetermined timing for image transfer. A plurality of conveyance rollers are disposed at appropriate locations along the main conveyance path 22A and the reverse conveyance path 22B. For example, a pair of paper discharge rollers 26 is located near the paper exit port 14.

The toner leakage preventing member 70 includes a toner leakage preventing cover 71 and a sealing member 72. The toner leakage preventing cover 71 is detachably attached to the main housing of the image forming apparatus 1 so as to extend along the main conveyance path 22A formed between the paper conveyance unit 22 and each of the drum unit 31U and the developing unit 33. The toner leakage preventing cover 71 is attached before transportation of the image forming apparatus 1 with toner installed. The toner leakage preventing cover 71 is a sheeted material that is cut out from a thick or PET sheet. The toner leakage preventing cover 71 is bent or curved to have a predetermined profile for easy attachment to the image forming apparatus 1. In one example, the sealing member 72 is an elongated member formed from urethane foam and has a trapezoidal cross section. The sealing member 72 is affixed to the toner leakage preventing cover 71 with for example double-sided tape or adhesive.

The toner leakage preventing member 70 is attached so as to partially cover the main conveyance path 22A from the front, as specifically described below. A lower end 71B of the toner leakage preventing member 70 has a shape that enables insertion thereof into a crevice 22C. The crevice 22C into which the lower end 71B of the toner leakage preventing cover 71 is inserted runs continuously from the sheet pickup section 21A to the main conveyance path 22A. An upper end 71A of the toner leakage preventing cover 71 is bent so as to be roughly L-shaped. The upper end 71A thus undergoes elastic deformation to engage with an outer shell of the cleaning device 35. When the lower end 71B is inserted into the crevice 22C and the toner leakage preventing cover 71 is pushed toward the drum unit 31U, the upper end 71A is brought into engagement with the outer shell of the cleaning device 35. As a result, the toner leakage preventing cover 71 is held in position partially covering the main conveyance path 22A from the front. The rear cover 12 can be closed with the toner leakage preventing cover 71 remaining attached so as to partially cover the main conveyance path 22A from the front. The toner leakage preventing cover 71 is sandwiched between the pair of registration rollers 23 as well as between the photosensitive drum 31 and the transfer roller 34. The configuration and position of the sealing member 72 are determined so as to close the gap between the photosensitive drum 31 and the development roller 33A, thereby preventing scattering of toner into the main conveyance path 22A.

On the main conveyance path 22A, a sheet detection sensor 81 is provided (for example, at a position upstream from the pair of registration rollers 23). The sheet detection sensor 81 may be a transmissive sensor or a reflective sensor. A portion of the toner leakage preventing cover 71 has a shape that physically or optically interferes with the sheet detection sensor 81 when the toner leakage preventing cover 71 is attached to the image forming apparatus 1. If power to the image forming apparatus 1 is turned on with this state, the image forming apparatus 1 is prevented from operating due to an error being detected by the sheet detection sensor 81.

Usually, the image forming apparatus 1 is shipped with the developing unit 33 containing no toner, and toner is installed by a user when setting up the image forming apparatus 1. However, according to commercial practice in some regions, initial setup carried out in a store prior to handing over the image forming apparatus 1 to a user may include toner installation and operational checkup. In a situation described above, conventional image forming apparatuses are insufficient in terms of measures taken for preventing toner leakage during transportation. According to the present embodiment, the toner leakage preventing cover 71 can be attached after the setup by a user or the setup in a store by a vendor, without having to remove the components such as the developing unit 33 and the drum unit 31U. In addition, the sheet detection sensor 81, which is usually used to detect a sheet, is used to detect the toner leakage preventing cover 71. The sheet detection sensor 81 detects an error when the toner leakage preventing cover 71 is left unremoved. As a result of the error detected, the image forming apparatus 1 is not placed into the ready state, which helps the user to recognize that the toner leakage preventing cover 71 has not been removed. That is, no printing operation can be performed unless the toner leakage preventing cover 71 is removed.

The toner leakage preventing member 70 is easily detachable when the rear cover 12 and the paper conveyance unit 22 are open. Reversely to the procedure for attaching the toner leakage preventing cover 71, first, the upper end 71A of the toner leakage preventing cover 71 is pulled away to disengage from the outer shell of the cleaning device 35. Then, the toner leakage preventing cover 71 can be pivotally tilted about the lower end 71B so as to uncover the front side of the main conveyance path 22A. Then, by upwardly pulling the lower end 71B out from the crevice 22C, the toner leakage preventing cover 71 is easily detached. The toner leakage preventing member 70 thus detached may be kept with a packaging box of the image forming apparatus 1 for future use in transporting the image forming apparatus 1 for repair. Therefore, the image forming apparatus 1 can be easily packed in a manner that ensures that toner leakage does not occur during transportation.

According to the present disclosure, the image forming apparatus 1 may be provided with a plurality of sensors including the sheet detection sensor 81 described above. In this configuration, the plurality of sensors may detect the presence of the toner leakage preventing member 70 when a portion of the toner leakage preventing cover 71 physically or optically interferes with the sensors at the same time.

According to the present disclosure, in addition, the image forming apparatus 1 may be provided with an operation section 15. The operation section 15 receives setting of a transportation mode, which a mode to be used when the image forming apparatus 1 is transported with the toner leakage preventing cover 71 attached thereto.

According to the present disclosure, in addition, the image forming apparatus 1 may be provided with a display section. When the sheet detection sensor 81 indicates sheet detection upon the first power-on after the transportation mode is set by a user, the display section displays a message for prompting removal of the toner leakage preventing cover 71.

According to the present disclosure, in addition, the idling drive time associated with a toner transfer operation is longer for the first power-on after the transportation mode is set than an idling drive time in a normal mode. The longer idling drive time ensures that the magnetic roller and the photosensitive drum are cleaned to more reliably remove toner that has become adhered thereto during transportation of the image forming apparatus 1.

The embodiment disclosed in the present specification is merely an example in every aspect and should not be taken to be limiting. The scope of the present disclosure is shown by the appended claims and not by the description of the embodiment given above. It is intended that the scope of the present disclosure covers all possible alterations within the meaning and scope of the appended claims.

The image forming apparatus according to the present disclosure is applicable for example to a copier, a printer, and a facsimile machine.

What is claimed is:

1. An image forming apparatus comprising:

a main housing;

a drum unit including a photosensitive drum;

a developing unit including a development roller configured to develop a toner image on the photosensitive drum;

a toner container configured to store toner therein;

a paper conveyance unit openable and closable relative to the main housing, the paper conveyance unit being disposed opposite to the drum unit and the developing unit when closed to constitute a conveyance path in which a sheet is conveyed;

a sheet detection sensor disposed in the conveyance path;

and a toner leakage preventing member removably attached to the main housing so as to extend through a space formed between the paper conveyance unit and each of the drum unit and the developing unit, wherein the toner leakage preventing member includes:

a toner leakage preventing cover formed from a sheeted material, and a sealing member formed from a foam material and fixed to the toner leakage preventing cover, the toner leakage preventing member is attachable to and removable from the main housing in a state in which the developing unit and the dram unit are attached to the main housing while the paper conveyance unit is open, and the sheet detection sensor mechanically or optically interferes with the toner leakage preventing cover while the toner leakage preventing cover is attached to the main housing.

2. The image forming apparatus according to claim 1, wherein the sheet detection sensor detects an error when power to the image forming apparatus is turned on with the toner leakage preventing member attached to the main housing.

3. The image forming apparatus according to claim 2, further comprising an operation section configured to receive an operation of setting a transportation mode for transporting the image forming apparatus with the toner leakage preventing member attached to the main housing, wherein when the sheet detection sensor indicates sheet detection upon first power-on of the image forming apparatus after the transportation mode is set, the operation section displays a message for prompting removal of the toner leakage preventing member.

4. The image forming apparatus according to claim 3, wherein an idling drive time associated with a toner transfer operation is longer for the first power-on after the transportation mode is set than an idling drive time in a normal mode.

5. The image forming apparatus according to claim 1, wherein the drum unit includes an outer shell, and the toner leakage preventing cover has an upper end in a shape that is brought into engagement with the outer shell of the drum unit.

6. The image forming apparatus according to claim 5, wherein when the paper conveyance unit is open and the upper end of the toner leakage preventing cover is pulled away from the drum unit to disengage from the outer shell, the toner leakage preventing cover is pivotally tilted about a lower end of the toner leakage preventing cover so as to uncover the conveyance path.

7. The image forming apparatus according to claim 5, wherein the upper end of the toner leakage preventing cover is bent so as to be roughly L-shaped.

8. The image forming apparatus according to claim 6, further comprising:

a paper feed cassette; and a sheet pick up section configured to feed a sheet from the paper feed cassette, wherein the lower end of the toner leakage preventing cover has a shape that enables insertion thereof into a crevice running continuously from the sheet pickup section to the conveyance path.

* * * * *